US009121418B2

(12) United States Patent
Wanie

(10) Patent No.: US 9,121,418 B2
(45) Date of Patent: Sep. 1, 2015

(54) TRANSMISSION SYSTEM AND METHOD OF REPAIR

(75) Inventor: Andrew J. Wanie, Jackson, WI (US)

(73) Assignee: AJ1E Superior Solutions LLC, Jackson, WI (US)

( * ) Notice: Subject to any disclaimer, the term of this patent is extended or adjusted under 35 U.S.C. 154(b) by 833 days.

(21) Appl. No.: 13/349,400

(22) Filed: Jan. 12, 2012

(65) Prior Publication Data

US 2012/0180651 A1 Jul. 19, 2012

Related U.S. Application Data

(60) Provisional application No. 61/431,988, filed on Jan. 12, 2011.

(51) Int. Cl.
*F15B 15/14* (2006.01)
*F15B 13/042* (2006.01)

(52) U.S. Cl.
CPC ..... *F15B 13/042* (2013.01); *Y10T 29/4925* (2015.01); *Y10T 29/49719* (2015.01); *Y10T 29/49726* (2015.01); *Y10T 29/49732* (2015.01)

(58) Field of Classification Search
CPC ..... F15B 15/1461; F16D 2121/04
USPC ..... 92/110
See application file for complete search history.

(56) References Cited

U.S. PATENT DOCUMENTS 2,360,578 A * 10/1944 Porter ..... 92/110
5,235,899 A * 8/1993 Hauser ..... 92/110
7,047,611 B1 * 5/2006 Rowell et al. ..... 29/401.1

* cited by examiner

*Primary Examiner* — F. Daniel Lopez
(74) *Attorney, Agent, or Firm* — Boyle Fredrickson, S.C.

(57) ABSTRACT

A transmission system and method of repair having a transmission servo rod received within a transmission housing bore, the rod having an aperture disposed along an exterior surface of the rod, configured to receive transmission fluid from a port within the transmission housing bore, a first recessed groove in the exterior surface of the rod disposed above the aperture; a second recessed groove in the exterior surface of the rod disposed below the aperture; and a first and second resilient sealing member received within the first and second recessed grooves, respectively, the resilient sealing members configured to engage an inner surface of the transmission housing bore.

19 Claims, 8 Drawing Sheets

TRANSMISSION SYSTEM AND METHOD OF REPAIR

CROSS-REFERENCE TO RELATED APPLICATION

This application claims priority from U.S. Provisional Patent Application Ser. No. 61/431,988, filed on Jan. 12, 2011, the entirety of which is hereby expressly incorporated by reference herein.

BACKGROUND OF THE INVENTION

1. Field of the Invention

The present invention relates in general to the field of transmissions, including, for example, Ford transmission models 5R55W, 5R55S, and 5R55N. More particularly, the present invention relates to a design and modification of OEM parts for these transmissions that, when used, repairs functionality to the intermediate and overdrive servos due to worn bores in the transmission housing.

2. Background of the Invention

Transmission servos, which are sometimes referred to as pistons, are used to activate different gear ranges within the transmission, along with other functions. Solenoids within the transmission open and close ports that apply and remove pressure to the servos allowing shifting, for instance, from $1^{st}$ gear to the intermediate range gears (e.g., $2^{nd}$, $3^{rd}$, $4^{th}$) and/or from $4^{th}$ gear to the overdrive (e.g., $5^{th}$ Gear, or above).

During normal operation, a solenoid activates to allow hydraulic fluid flow and pressure to the piston side opposite the direction you want the servo to move. The transmission is designed such that the pistons' surface area is sufficiently large to receive sufficient force against the pistons, provided by the fluid pressure delivered by the transmission pump, and applying that force onto the bands of the gear range being activated via the servo rod.

In the designs of the transmissions specified, the servo consists of a hardened shaft that is attached to the piston. This hardened shaft passes through an aluminum bore machined into the transmission housing. A port is located within the bore that, when opened by the solenoid, passes fluid through a cross bore in the rod to a center bore in the rod and up to the front side of the piston.

The theory in the original design is that, through the passage of fluid to the front side of the piston, pressure builds up between the servo cap/cover and the piston. This is accomplished by seals around the diameter of the piston and around the diameter of the servo cap/cover. These are the only two places where seals are originally designed into the system.

Due to the forces acting on the servo rod, i.e., the repeated activation and deactivation, as well as the reaction forces to the coupling to the transmission bands and other forces, over time, the hardened steel shaft wears on the aluminum bore and causes leakage to the back side of the piston. This leakage causes back pressure on the servo rod and opposite pressure applied to the piston head, as well as leakage into the transmission reservoir. Both of these results in a reduced amount of fluid pressure available to the front side of the piston which in turn reduces the available force to the bands and causes the gear ranges that are being activated to not work properly. The bands slip when there is not enough force, which causes unsafe driving conditions or, at a minimum, severely decreased performance.

The only means of fixing this, up to the proposed invention, was to remove the transmission and do a partial disassembly of the transmission. Then the servos would need to be removed, and the bores for the rods would need to be machined out and sleeves made of a more wear-resistant material pressed into the bored out bores. This method requires a high level of skill and a large set of expensive equipment to perform. If this procedure is performed by a mechanic or dealer, it ends up running into the thousands of dollars. Also, given the complicated level of skills required, it severely limits the ability for someone with reasonable mechanical ability to perform the work themselves. This invention provides a very cost-effective fix that can be performed by most people with minimal mechanical abilities. It is also the most cost-effective fix in the market to date that is available to mechanics, dealers, and repair shops.

SUMMARY AND OBJECTS OF THE INVENTION

According to the main aspect of the present invention, the OEM parts for the model year of the vehicle's transmission are taken and o-ring grooves are machined on either side of the cross bore on the servo rod.

Due to wear in the aluminum housing, the bore becomes ob-round along the length of the transmission housing bore. This ob-round wear is more pronounced at the end through which the rod protrudes, i.e., nearest the piston head, and becomes less severe on the opposite side, i.e., the side nearest the transmission reservoir.

The original OEM design is such that a small amount of transmission fluid would leak up to the back side of the piston and also to the rod end side and back into the transmission reservoir. The fluid going to the back side of the piston causes back pressure and the fluid passing to the reservoir causes loss in pressure. The differential in the amount of fluid passing to the front side of the piston and that to the back side and into the reservoir is small enough initially in the life of the vehicle that the transmission works properly.

However, as the bore wears, this differential becomes too large for the transmission to function properly. This invention restores this differential and pressure to the top side of the piston to better than the original pressures, thereby fixing the problem. More importantly, this is done at a very cost-effective solution, only costing a few hundred dollars, and can be done by a person with reasonable mechanical ability.

These and other aspects and objects of the present invention will be better appreciated and understood when considered in conjunction with the following description and the accompanying drawings. It should be understood, however, that the following description, while indicating preferred embodiments of the present invention, is given by way of illustration and not of limitation. Many changes and modifications may be made within the scope of the present invention without departing from the spirit thereof, and the invention includes all such modifications.

BRIEF DESCRIPTION OF THE DRAWINGS

A clear conception of the advantages and features constituting the present invention, and of the construction and operation of typical mechanisms provided with the present invention, will become more readily apparent by referring to the exemplary, and therefore non-limiting, embodiments illustrated in the drawings accompanying and forming a part of this specification, wherein like reference numerals designate the same elements in the several views. In the drawings.

DETAILED DESCRIPTION

Figure 1:
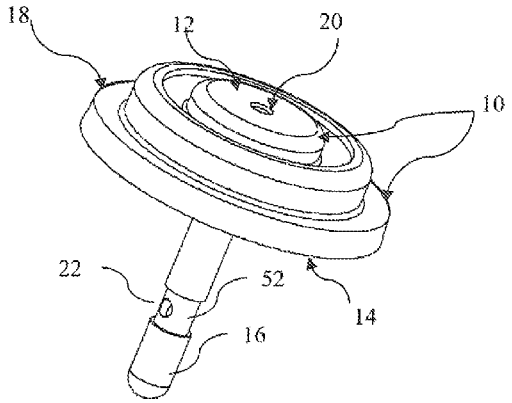
FIG. 1 PRIOR ART
FIG. 1 is an isometric view of an OEM servo detailing a rod, piston, and relative position of parts and characteristics used to describe the invention.

The present invention and the various features and advantageous details thereof are explained more fully with reference to the non-limiting embodiments described in detail in the following description.

1. Detailed Description of Preferred Embodiments

With reference now to the drawing figures in which like reference numerals designate like parts throughout the disclosure.

Figure 7:
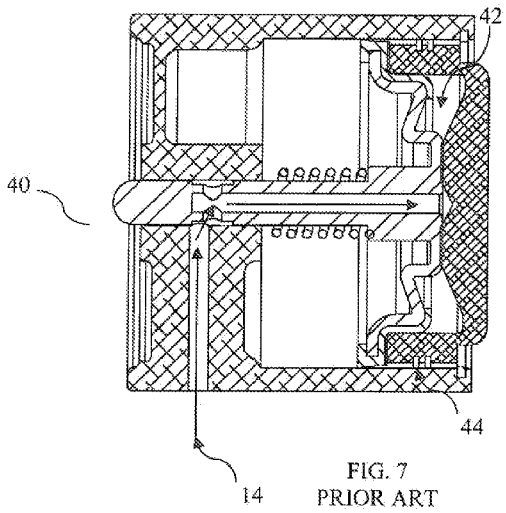
FIG. 7 PRIOR ART
FIG. 7 is a cross section cut through a center of the bore section showing a fluid path and the original condition and clearances in the parts.
Figure 8:
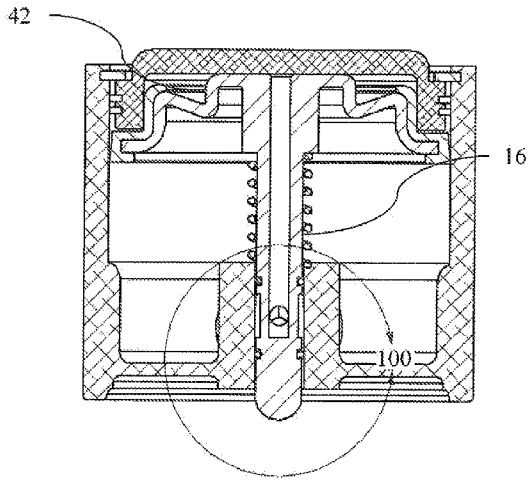
FIG. 8 is a cross section 90° from the section in FIG. 7.
Figure 9:
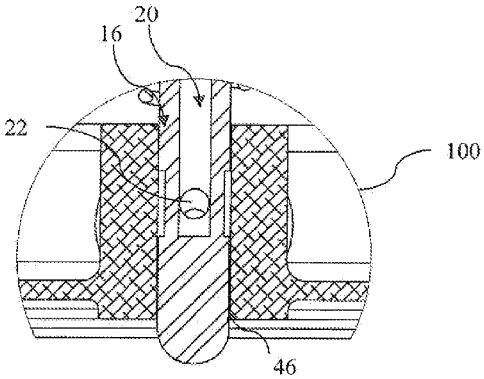
FIG. 9 PRIOR ART
FIG. 9 is a scale 2:1 detailed view showing the areas where OEM clearances were designed into the system.
Figure 10:
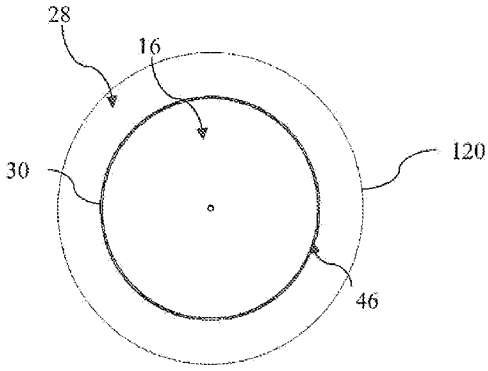
FIG. 10 is a scale 6:1 detailed view of the bottom of a rod as it would appear from inside the transmission, showing OEM design clearances between the rod and bore where transmission fluid is allowed to leak.
Figure 11:
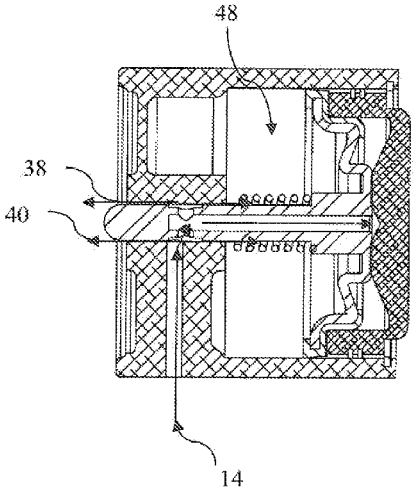
FIG. 11 PRIOR ART
FIGS. 11 & 12 are cross section views showing wear to a bore over the life of the vehicle and additional flow points of transmission fluid causing pressure loss.
Figure 12:
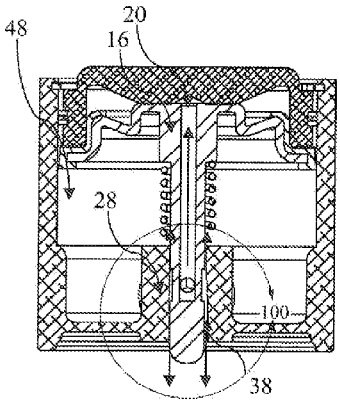
FIG. 12 PRIOR ART
Figure 13:
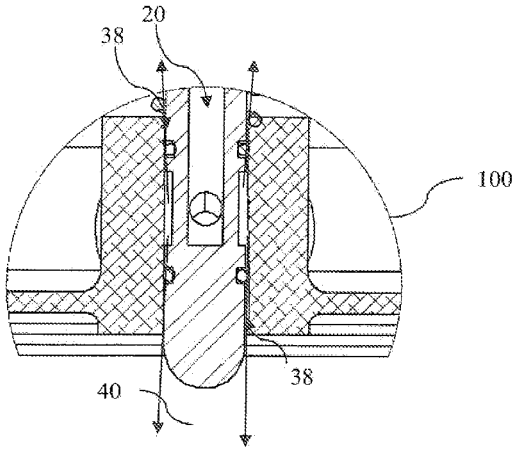
FIG. 13 is a scale 2:1 detailed view showing the increased clearance due to normal operating wear on a bore.
Figure 14:
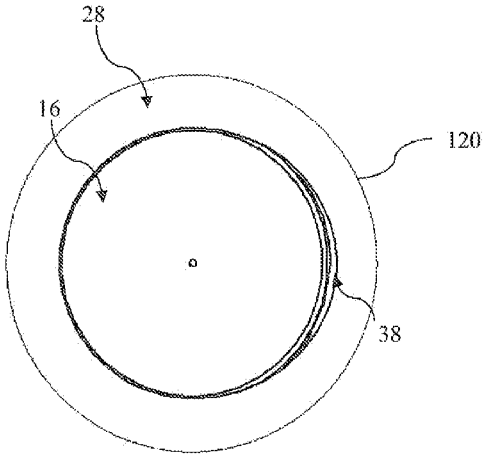
FIG. 14 is a scale 6:1 detailed view showing an ob-round shaped wear on a bore looking at the end view of a rod as it would appear from inside the transmission reservoir.
Figure 15:
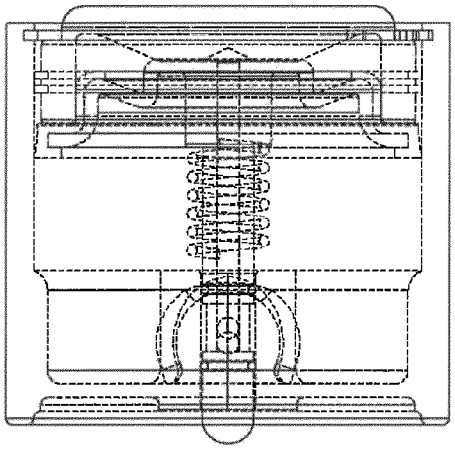
FIGS. 15 & 16 are side and front views (hidden lines shown), showing the modified OEM parts with o-ring grooves and o-rings.
Figure 16:
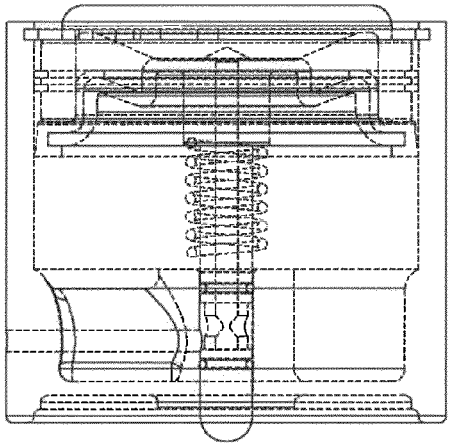
Figure 17:
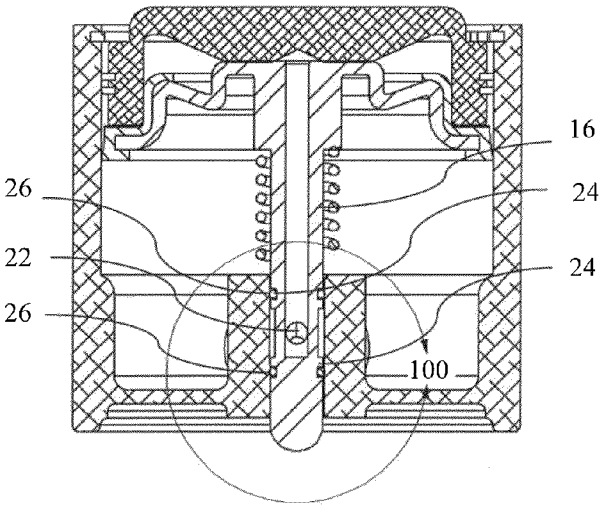
FIGS. 17 & 18 are cross sections showing modified parts with o-ring grooves and o-rings sealing against the bore.
Figure 18:
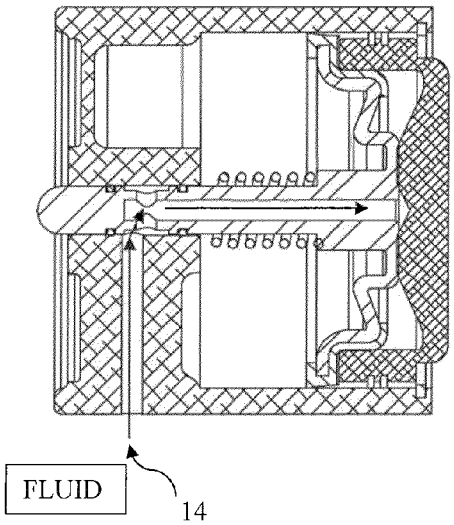
Figure 19:
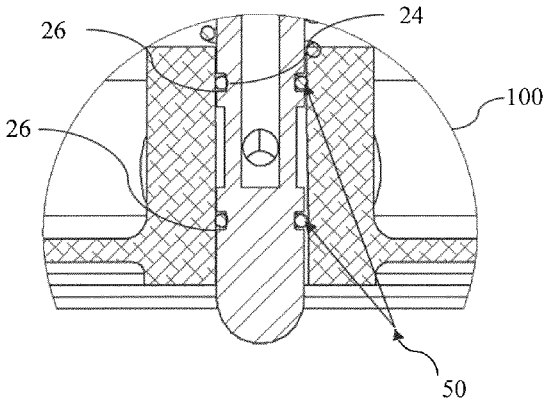
FIG. 19 is a scale 2:1 cross section showing o-ring grooves and o-rings, sealing a bore and directing fluid through a rod bore.

The OEM servos consist of a rod 16 and piston 12 & 18 (see FIG. 1). The servos have a cross bore 22 that is centered on a wide groove 52 that is machined into the rod. The large groove allows for fluid to pass into the cross bore 22 while the servo is extending and retracting (see FIGS. 1, 4, 6, 7, and 21). The rod 16 on the servo has a bore 20 running through the center of the rod from the cross bore 22 to the top of the piston 12 (see FIGS. 1, 4, 6, 7 & 8). As part of the OEM design, when the solenoid (not shown) for that servo is activated, the pressurized transmission fluid passes through the cross bore 22 in the rod 16 up to the top side of the piston 12 between the piston 10 and the servo cap 36. Some fluid also passes to the bottom side of the piston 14 and to the reservoir 40 (See FIGS. 1 and 7). This is an inherent part of the OEM design. The system is designed such that the intermediate servo which engages, for example, the $2^{nd}$ through $4^{th}$ gear range, and the overdrive servo (not shown), which engages for example the overdrive or $5^{th}$ gear, has an acceptable amount of transmission fluid that leaks past the clearances 46 between the servo rod 16 and the servo bore 20. Therefore, given the design, a percentage of fluid is designed to not flow to the top of the piston on the servo (see FIGS. 7-10). When the clearances between the rod and the bore 46 are still small enough, there is sufficient pressure 42 supplied to the top of the piston 12 to properly activate the desired gear range.

Referring now to FIGS. 11-14, when the forces acting on the servo rod as a result of the interaction with the servo strut (not shown) attached to the band (not shown) act on the rod 16 while it is extending and retracting, wear forces apply to the wall of the bore 30. Gradually, over time, the bore wears 38 to an ob-round shape. The clearances gradually increase to a point where too much back pressure 48 on the bottom side of the piston 14 builds up, working against the pressure 42 running through the bore 20 and to the top side of the piston 12. Also, increased leakage into the reservoir area 40 decreases pressure 42 from the top side of the piston 12, causing malfunctions in the transmission. The clearances 38 that are worn into the bore 30 are greatest at the rod 16 end and gradually reduce as toward the piston 10 end.

The symptoms of this failure or malfunction are as follows. For the intermediate servo which controls the band (not shown) that activates the $3^{rd}$-$4^{th}$ gear range, the servo can no longer apply the appropriate amount of force 42 to the strut (not shown) and band (not shown) to keep the band from slipping. This will result in flairs or hesitations over time when shifting from $3^{rd}$ to $4^{th}$ gear. Because of the reduced pressure to the top of the piston, the bands will slip and prematurely wear causing failure. Also, for the intermediate range, this causes a severe performance issue when accelerating. For the overdrive servo, the same wearing takes place over time. However, the symptoms of failure are different. Due to the same reduced pressure on the top of the piston, the overdrive band (not shown) slips easier and easier over time, causing $5^{th}$ gear to drop in and out more easily. Eventually, the pressure to the top of the piston is reduced enough such that the overdrive will no longer stay in gear. Since the computer controlling this function attempts to keep it in $5^{th}$ gear and it cannot stay in gear, it registers another failure code, and illuminates the check engine light. Eventually, overdrive will not stay engaged at all and the only way to drive the vehicle without errors is to immediately, manually turn the overdrive off before driving the vehicle. Another symptom for the overdrive wear is under heavy loads, the engine RPM gradually increases over time when shifting from $1^{st}$ to the $2^{nd}$. When the loss in pressure is large enough, the engine RPM may redline, and the only way to shift into $2^{nd}$ is to let up on the accelerator. The transmission will ordinarily shift into $2^{nd}$ at that point but because of the reduced pressure to the top of the piston, the bands will slip and prematurely wear causing failure.

Up to the point of this invention, the only means of repairing the transmission was to take it to a dealer or repair shop and have them perform a full rebuild of the transmission. This is only accomplished by the most experienced of transmission mechanics and requires dropping the transmission out of the vehicle. Specifically, to fix the worn bore 38, an experienced mechanic uses specialized tooling to ream the bores to a larger diameter. Then a sleeve made of a harder material is pressed into the reamed-out bore, which brings the clearances between the rod and the sleeve back to the original clearances of when the transmission was new. Not all kits to sleeve the transmissions are the same. Some still see continued wearing and the sleeves need to be replaced again over time.

The expense of doing the bore and sleeve operation on the overdrive and intermediate servo bores is very expensive, perhaps ranging from the low $2,000 range to over $3,000. Given the usual higher mileage of these vehicles, the owners are usually hesitant to invest that much money into the repair. Also, many people that want to do their own repair work do not have the skill level required to perform the bore and sleeve operation and the transmission rebuild. Even if they are capable of doing this work, they would still have to buy the specialized tooling, which often runs in the $500 range, and spend many more hours performing this repair.

This invention addresses the described problems, including for the Ford 5R55W, 5R55N, and 5R55S transmissions, without dropping the transmission; does it at a very cost-effective price; and can be done by most anyone with minimal mechanical experience.

Figure 2:
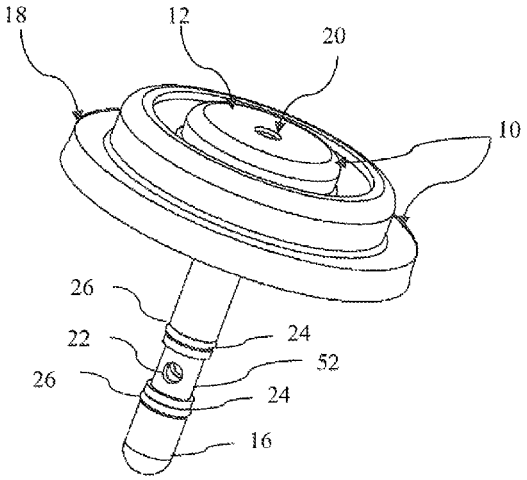
FIG. 2 is an isometric view of a modified OEM part with machined o-ring grooves and o-rings.
Figure 3:
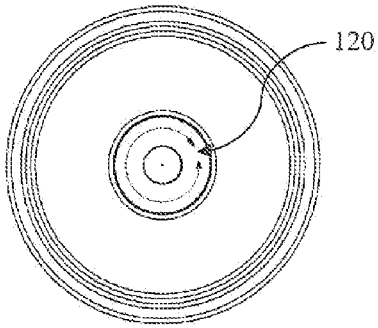
FIG. 3 is a bottom view of a core section of an intermediate servo as it would appear from inside a transmission looking out.
Figure 4:
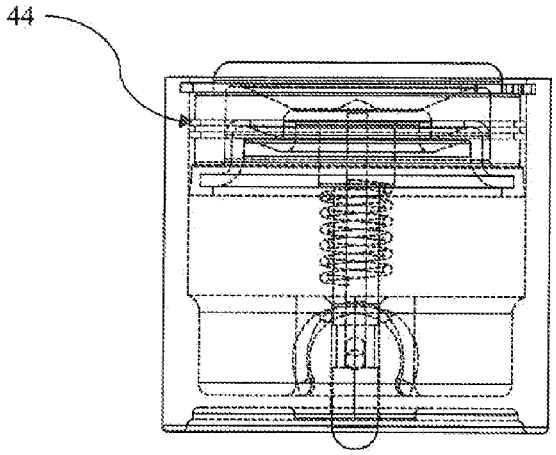
FIG. 4 PRIOR ART
FIG. 4 is a front view of a core section of the intermediate servo showing the servo, including the piston, bore the rod goes through, snap ring, and return spring.
Figure 5:
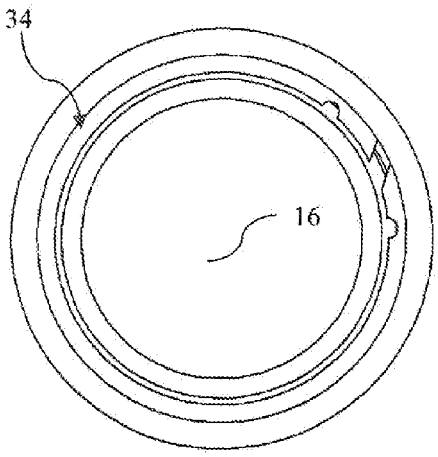
FIG. 5 is a top view of a bore section of the intermediate servo showing a cap and the snap ring that holds the cap in place.
Figure 6:
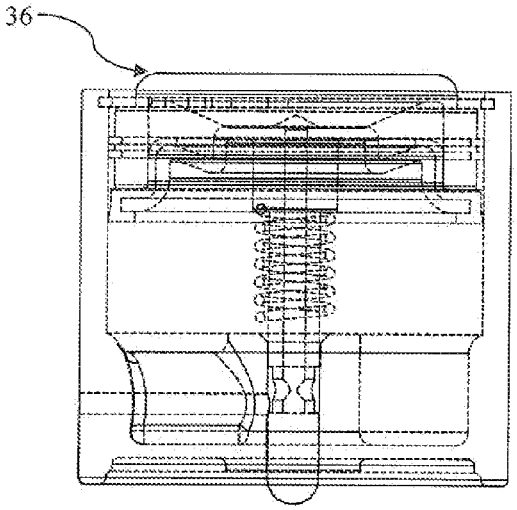
FIG. 6 PRIOR ART
FIG. 6 is a side view of the bore section of the intermediate servo showing a fluid port and the same components as in FIG. 5.

Referring to FIG. 2, an embodiment of the invention takes the existing OEM service parts (Overdrive Servo and the Intermediate Servo) and machine o-ring grooves 24 on either side of the cross bore 22 and installs o-rings 26.

For this application, the depth, width, and location of the grooves 24 are determined, along with the appropriate material and size of o-ring 26 for the transmission application. For example, with the Ford 5R55W, 5R55N, and 5R55S transmissions, the servo extends and retracts about ¼" during normal operation. Therefore, the position of the grooves 24 is determined such that the o-ring 26 stays within the bore 30 during operation (see FIGS. 15-19 and 21).

With the worn bores 50, and especially with non-symmetrical wearing, o-rings would not be thought of to be used because you still run the risk of leakage around the o-rings. O-rings are generally used where the seal points remain relatively unchanged and concentric over the life of the product.

Figure 20:
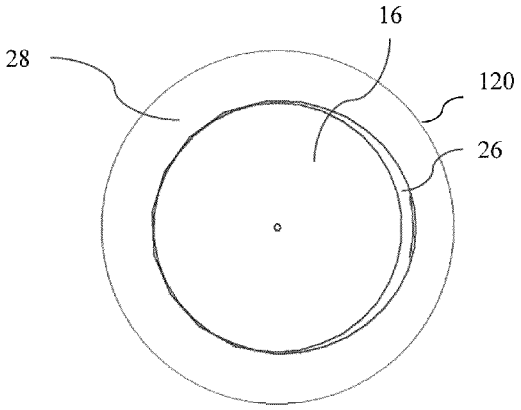
FIG. 20 is a scale 6:1 detailed view of the end of a rod and a bore showing the o-ring sealing an ob-round wear point.
Figure 21:
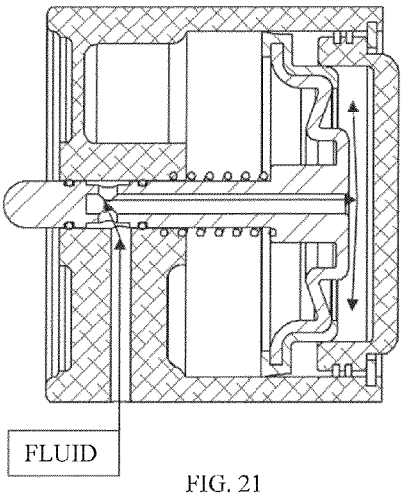
FIG. 21 is a section view showing a servo extended and the relative positions of o-rings with respect to the ends of a bore, as well as redirection of fluid flow.
Figure 22A:
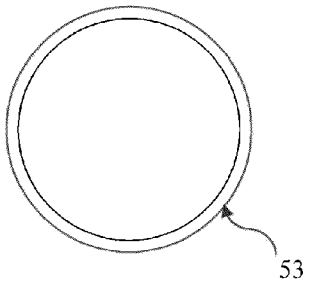
FIG. 22A is a two-dimensional top view of an assembly sleeve.
Figure 22B:
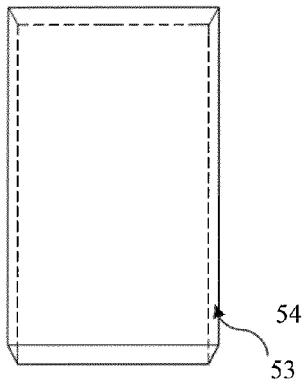
FIG. 22B is a two-dimensional front view of an assembly sleeve.
Figure 22C:
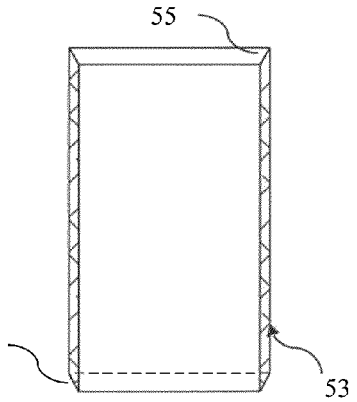
FIG. 22C is a two-dimensional cross section of an assembly sleeve.
Figure 22D:
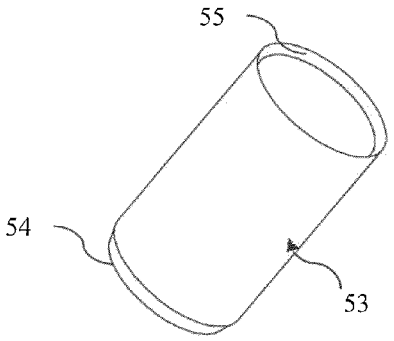
FIG. 22D is an isometric view of an assembly sleeve.
Figure 23:
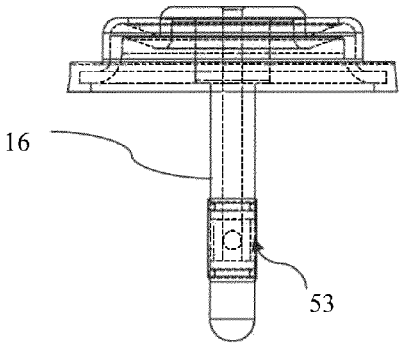
FIG. 23 is a two-dimensional view of an intermediate servo with an assembly sleeve shown in the installed position prior to installation of the servo into a bore.
Figure 24:
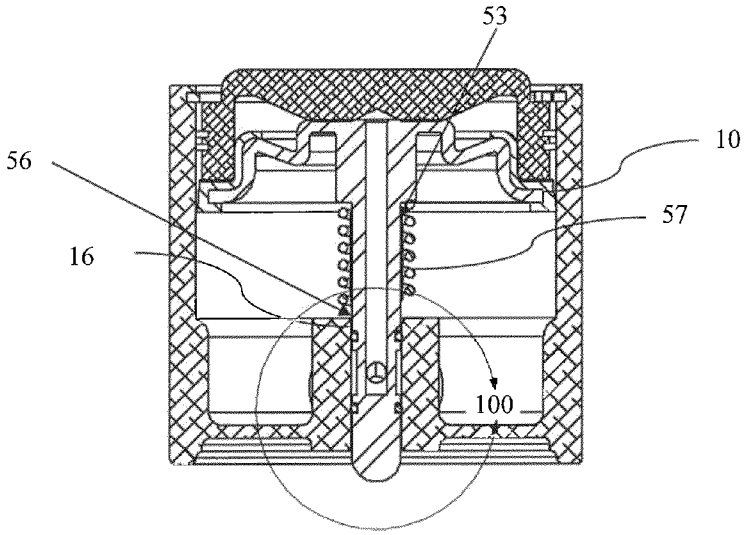
FIG. 24 is a cross section showing an assembly sleeve in the operating position after installation of the servo into a bore.
Figure 25:
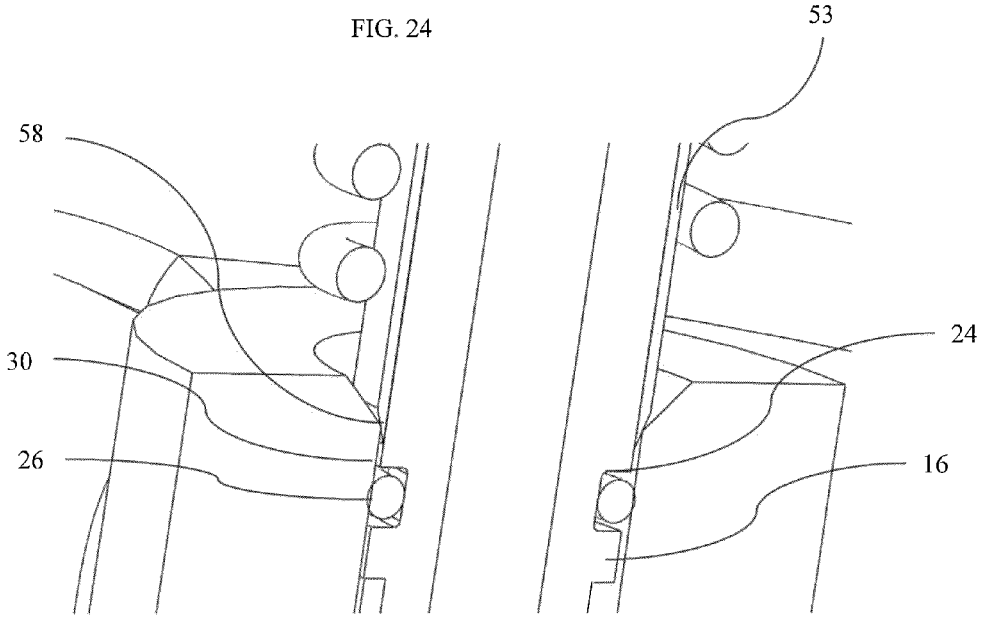
FIG. 25 is a cross section showing the contact of an assembly sleeve with an OEM chamfer allowing o-rings to slide directly into the bore.

However, in this application, since the original design accounted for minimal leakage to operate 46, even if the o-rings do not completely seal the clearances between the rod 16 and the bore 30 (see FIG. 20), the overall leakage is still much less than the original leakage designed into the system.

The cross section of the o-rings 26 exposed to fluid pressure is so small that they may only see a couple of PSI in pressure, which allows for very high longevity in this application. Even if the o-ring 26 is cut, the pressures are low enough and the clearances are small enough that the o-ring 26 will not extrude and fail nor will it cause enough pressure 42 loss even if portions of the o-ring are lost.

In order to replace the servos, one does not have to drop the transmission, and the skill level required to perform the work is greatly reduced from that required by doing a full rebuild. The work can be performed by most people with reasonable mechanical ability and with inexpensive tools that are usually available in most people's tool boxes. Although, in tight quarters, all the work can be performed with the transmission installed and removing a few parts. By any experienced mechanic with the correct tools, the work could be performed in less than four hours. For a less experienced person, the work can be done in four to six hours.

In another aspect of the invention to better aid in installation of the servos, a machined aluminum or plastic sleeve 53 is installed over the o-rings 26 prior to the installation of the piston 10 (see FIGS. 22A-22D and 23-25). The sleeve 53 has an external chamfer 54 on the external diameter on one end and an internal chamfer 55 on the opposite end. The sleeve 53 may have, for example, an overall length of about 0.876 inches ±0.010 inches with an external diameter of about 0.514 inches ±0.005 inches and an internal diameter of about 0.474 inches +0.002 inches / −0.001 inches. The external chamfer 54 may have, for example, an angle of about 19°±2° (with a reference length of about 0.06 inches), and the internal chamfer 55 may have an angle of about 30°±1°. The sleeve has three purposes. The first purpose of the sleeve is to compress the o-rings 26 in a more controlled manner outside of the vehicle. During installation of the sleeve 53 on the servo 10, the internal chamfer 55 guides and compresses the o-rings 26 into the sleeve. This eliminates the possibility of damaging the o-rings 26. The second purpose of the sleeve is to eliminate the need to chamfer the bores as described in the instructions below. The chamfer on the outer diameter of the sleeve 54 seats against the servo bore OEM chamfer 56 to form a contact point 58 and allows for the o-rings to slide from under the sleeve 53 directly into the servo bore 20 of the transmission without any damage. This addition also allows for installation of the servo 10 by only removing one part of the exhaust which takes as much as 4 hours less in time to perform the repair. The third purpose is to resize the o-rings after installation onto the piston rod 16.

The design of the sleeve 53 is such that it pushes up out of the way during installation, rides between the piston rod 16 and the return spring 57, and does not interfere with the normal operation and stroke of the piston.

If one uses his own labor, the repair can be done for less than a few hundred dollars for out-of-pocket expenses. Even if one employs a mechanic to perform the work, the total cost would only run in the $500-$600 dollar range, which is much more cost effective than the $2,000 to $3,000 for the bore and sleeve operation. This is a much more tolerable cost for the fix, especially given the higher mileage of the vehicle.

2. Example and Instructions

The following instructions and repairs were developed after research, design, and reasoning into the following issues with the Ford 5R55W transmission, provided by example only.

A. Symptoms.

A Ford 5R55W Transmission on 2002 Mercury Mountaineer, 4.6 L V8, All Wheel Drive, with 104,000 miles after one transmission rebuild around 76,000 miles for broken bands:

1. The Transmission would not hold in OD/$5^{th}$ gear, gradually worsening over time. Eventually, the Transmission would not shift back into OD unless travelling down an incline. The Transmission would shift out of OD after any sign of load, especially after warming up.

2. The Transmission would not shift out of $1^{st}$ gear into the intermediate range. The engine would redline and not shift unless you let up on the accelerator. The Transmission would shift from $1^{st}$ to $2^{nd}$ gears if you accelerate very slowly.

A combination of one and or two would produce a flashing OD light, and eventually illuminate a service engine soon light. Codes returned for the described situation include "P0775 Pressure Control Solenoid B Circuit Malfunction."

B. Before Performing the Repair.

Before performing the repair, all transmission solenoids and sensors were checked for the proper resistance (all checked okay); an engine tune-up was performed (no difference noticed); and the throttle position sensor was replaced (no difference was noticed). The automotive dealer inspected the transmission and recommended a full rebuild or a replacement with a rebuild at a cost of around $2,600 to $3,100. The automotive technician suggested that the OD and Intermediate servo bores were worn and needed to be bored out, reamed, and sleeved.

This repair will also work on the Ford 5R55S & 5R55N transmissions, for example, and has the potential to work on other transmissions with bore-wearing problems. For example, the 5R55N has three different intermediate servo part numbers. With the parts and instructions, the servos can be replaced in perhaps two to four hours, depending on the tools and equipment available. The instructions provide the insight to get the job done correctly and quickly, without dropping the transmission. The instructions include recommended tools, figures, and step-by-step detail.

On the other hand, if trying to machine the o-ring grooves yourself, it will require calculations, custom part holding, measuring, special tools, and cutters.

C. Performing the Repair.

Recommended tools and supplies may include, for example, a car lift (or adequate stands); a full set of metric wrenches; a metric socket set with ⅜" standard drive; long socket extensions; an impact wrench and or ⅜" air socket drive; a ⅜" universal adapter; a large snap wring tool (rings are flats, not holes), or needle nose pliers; a large pry bar, around 18-24"; a small block of wood, for example, 1" thick by 2" long; a small flat screw driver or o-ring pick; a #10 or 13⁄64 drill bit; channel lock pliers, needle nose pliers, and/or a long handled right angle needle nose pliers; a ¾ to 1" chamfering tool; suitable transmission gel; a 19 mm open end wrench or adjustable wrench; a ¼" square socket; an extra short ⅜" drive ratchet; a torque wrench (capable of 120 in-lbs (10 ft-lbs)) for recommended band adjustment; suitable lubricant, such as WD-40®; anti-seize; a drain oil pan; a work light; rags; anew transmission filter and transmission fluid (if an optional transmission fluid change is performed); and new servos with machined grooves and o-rings.

Raise the vehicle up on a lift or on stands. Make sure it is safe and secure, and use jack stands for added safety (Warning: if performing the repair on stands, jack stands should also be used, the parking brake should be set, and the wheels should be blocked). Spray the nuts and bolts on the catalytic converter at the manifold on both sides and at the joint where they meet the muffler (see FIGS. 22 & 23). Remove the bolts from the top heat shield and leave in place loose until the converter is dropped (see FIGS. 24 & 25). Remove the bolts from the rear heat shield. Disconnect the three oxygen sensor cables on the converter pipes and tuck them safely away (Note: There are three to disconnect, one each near each manifold at the top, and one on the side of the transmission case). Remove the bolt from the hanger. Remove the bolts from the converter in the locations mentioned above. Disconnect and move the convert pipe assembly and remove the hanger and then rotate the right side of the assembly down to give clearance to the two servos. Remove and set aside the top heat shield (Note: If doing this on stands, it is highly recommend to remove the transmission cross-member and y-pipe completely to have better access and save you time).

Next is the servo removal and installation. Place the 1" block of wood on one of the servo caps and then insert a pry-bar between the wood and the sheet metal side of the passenger compartment. The cap and servo will compress together to relieve pressure on the snap wring. Note: it is useful to have an extra person to assist. If an extra person is not available, you can take a piece of wire wrapped around the pry-bar and around the opposite side frame and tie it off to hold pressure; you have to treat it gingerly to avoid knocking it of the cap; you may also be able to use a bungee cord or twine.

With the large snap-ring tool, or with needle nose pliers, compress the snap wring. Note: if the position of the notches in the ring is in a poor location to reach, rotate them into a better position while pressure is off of it. Note: you may have to put some side pressure toward the wall of the bore to keep a good grip on the snap-ring.

When you compress the ring, the opposite side should lift out. Gradually release the pressure on the cap and the snap ring should push out and remain out on the side opposite the grooves. It should be enough to get a very small screw driver or o-ring pick between it and the side wall of the bore.

Gradually work the screw driver around prying as you go until you can slide the screwdriver up and over the top of the cover. Once you are in that position, carefully pry the snap wring out.

Place a drain pan under the area of the cover.

Once the snap-ring is out, you can remove the cover by rocking it back and forth and applying outward pressure. You can also use a flat-bladed screwdriver to dig into the side of the cap and pry it out going from one side to the other in doing so. Note: you will get some fluid running out at this point, but not more than a cup.

The servo may slide out easily at this point, but if not, if you take a #10 drill bit and insert the smooth end into the bore, by putting a little side pressure on it, and slight prying pressure with a channel lock pliers, you can pull the servo out. Note: any drill bit, or pin slightly smaller than the ID of the bore will work. Keep the return spring for reuse.

In order not to cut the o-rings during installation of the new servos, the machined bores need to have a slight chamfer put on them. Take your chamfering tool and put a liberal amount of transmission gel on it. This is to help catch aluminum that comes off Note: this can be done by hand, but if you have a small right angle air ratchet or drill, you can use that also. Turn the tool by hand in the bore with reasonable pressure for a total of about two full rotations. Note: the size is hard to measure and breaking any of the sharp edge will be sufficient. If you do not have any gel which is the consistency of light-weight grease, a piece of emery paper may be used to break the edge. That way, you will have dust instead of chips and if that ends up in the transmission the filter will pick it up.

Remove the tool and check the bore, perhaps with your little finger, and try to remove any residual chips.

Making sure the servo cap is clean, apply a liberal amount of transmission gel to the seal on the cap, and onto the side of the servo seal. Also apply some to the o-rings and shaft of the servo. At a minimum, apply transmission oil to the parts for lubrication during installation.

Pre-assemble the servo into the cap.

Make sure to re-install the return spring on the new servo shaft at this point.

Insert the assembly into the bore in the case until you feel resistance at the 1st o-ring.

Place the pry-bar with or without the block of wood into the same location as described above, and force the servo into the bore until you can see the full snap-ring groove. At this point you can temporarily release pressure.

Note: it is useful to have an extra person to assist. Using the same procedure as described above, compress the servo and cap until you can see the full groove for the snap-ring. Backing out the band adjustment may make this easier at this point. There may be a risk of the strut falling if this is done, but that is unlikely.

Place one end of the snap ring around the cap and into the groove. With the small screw driver and some pressure around the other side of the ring with your hand, work your way around the ring with the screw driver until the ring snaps in place. Warning: make sure to check that the ring is fully seated. Repeat for the other servo.

D. Performing a Band Adjustment.

It is highly recommended to also perform a band adjustment. Given that the bands have been slipping because of the servo issue, the bands are probably worn and will need adjustment. Also, you should consider inspecting and replacing them, if necessary.

Spray the adjustment bolts with WD-40 or other lubricant to help loosen them. Wire-brush the threads, if possible. With a 19 mm wrench, or other appropriate tools, loosen the lock nut on the band. Then, with the ¼" square drive or wrench, turn the lock nut out enough so you can turn the bolt in until you feel slight resistance on the band. Attach the torque wrench and turn in to 120 in-lbs. Next mark a spot on the bolt or nut with a Sharpie. Then turn the adjustment bolt out two full turns, and with the same wrench, hold the adjustment bolt and turn the lock nut in until tight. Recommended tightness for the nut is 40 Ft-lbs. Repeat for the other band.

E. Re-Installing the Converter.

Apply anti-seize to all the bolts. Install the upper heat shield. Install the rear heat shield. Install the hanger onto the post on the tube. Position and install the converter on the right side, then the left making sure the hanger bracket is positioned over the cross member. Install hardware and tighten the connection from the converter to the muffler/exhaust. Reconnect all the sensor connectors.

The vehicle is ready for a test drive. Note: A short break in period may be necessary, so the problem may not disappear immediately. Most if not all symptoms should go away immediately. Note: it is highly recommend driving 100 miles or so and then replacing the transmission filter and fluid. That will give any particles that may have dislodged a chance to get caught in the old filter. Also with all the slipping on the bands, the fluid may be ready for changing. However, as long as the vehicle is raised, the fluid and filter may be changed right away. Changing the fluid will typically require 5 quarts of the proper transmission fluid. There is a fill stand pipe in the bottom of the pan. So when the drain is open and while filling, as soon as fluid comes out it is full, given the vehicle is level.

It is specifically intended that the present invention not be limited to the embodiments and illustrations contained herein, but include modified forms of those embodiments including portions of the embodiments and combinations of elements of different embodiments as come within the scope of the following claims. Various alternatives are contemplated as being within the scope of the following claims which particularly point out the claimed subject matter regarded as the invention.

What is claimed is:

1. A transmission servo rod receivable by a transmission-housing bore, the rod comprising:

an aperture disposed along an exterior surface of the rod configured to receive transmission fluid from a port within the transmission housing bore;

a first recessed groove in the exterior surface of the rod disposed above the aperture;

a second recessed groove in the exterior surface of the rod disposed below the aperture;

first and second resilient sealing members received within the first and second recessed grooves, respectively, the first and second resilient sealing members configured to engage an inner surface of the transmission housing bore; and an assembly sleeve surrounding a portion of the exterior surface of the rod above the first recessed groove, wherein the assembly sleeve comprises an external chamfer on an external diameter on one end of the assembly sleeve and an internal chamfer on an internal diameter on the opposite end of the assembly sleeve, wherein the internal chamfer is operable to resize at least one of the first and second resilient sealing members upon installation onto the rod, and wherein the first and second resilient sealing members are configured to predominately provide a fluid seal for a non-symmetrical wear of the transmission housing bore.

2. The rod of claim 1 wherein the first and second resilient sealing members allow a fluid leakage between the rod and the transmission housing bore, such that a volume of transmission fluid is released to a back side of the transmission servo rod.

3. The rod of claim 2 wherein the volume of transmission fluid released to the back side of the transmission servo rod is less than a volume of transmission fluid received on a front side of the transmission servo rod by means of the aperture.

4. The rod of claim 1 wherein the first and second resilient sealing members predominately provide the fluid seal for the non-symmetrical wear of the transmission housing bore in response to a one quarter inch longitudinal movement of the transmission servo rod.

5. The rod of claim 1, wherein the transmission servo rod is a first transmission servo that is an intermediate servo for activating an intermediate gear range, and further comprising a second transmission servo that is an overdrive servo for activating an overdrive gear range.

6. The rod of claim 1, wherein the assembly sleeve is manufactured from aluminum.

7. The rod of claim 1, wherein the assembly sleeve is manufactured from plastic.

8. The rod of claim 1, wherein the external chamfer of the assembly sleeve is configured to seat against a chamfer of the transmission housing bore to form a contact point.

9. The rod of claim 8, wherein at least one of the first and second resilient sealing members is configured to slide from under the assembly sleeve directly into the transmission housing bore.

10. The rod of claim 1, further comprising a third groove in the exterior surface of the rod disposed between the first and second grooves, wherein the third groove is wider than the first and second grooves, and wherein the aperture is substantially centered in the third groove.

11. A transmission servo rod receivable by a transmission-housing bore, the rod comprising:

an aperture disposed along an exterior surface of the rod configured to receive transmission fluid from a port within the transmission housing bore;

first and second recessed grooves in the exterior surface of the rod disposed above and below the aperture, respectively;

first and second o-rings received within the first and second recessed grooves, respectively, the first and second o-rings configured to engage an inner surface of the transmission housing bore, wherein the first and second o-rings are configured to predominately provide a fluid seal for a non-symmetrical wear of the transmission housing bore; and an assembly sleeve surrounding a portion of the exterior surface of the rod above the first recessed groove, wherein the assembly sleeve comprises an external chamfer on an external diameter on one end of the assembly sleeve and an internal chamfer on an internal diameter on the opposite end of the assembly sleeve, and wherein the internal chamfer is operable to resize at least one of the first and second o-rings upon installation onto the rod.

12. The rod of claim 11, wherein the first and second o-rings allow a fluid leakage between the rod and the transmission housing bore, such that a volume of transmission fluid is released to a back side of the transmission servo rod.

13. The rod of claim 12, wherein the volume of transmission fluid released to the back side of the transmission servo rod is less than a volume of transmission fluid received on a front side of the transmission servo rod by means of the aperture.

14. The rod of claim 11, wherein the first and second o-rings predominately provide the fluid seal for the non-symmetrical wear of the transmission housing bore in response to a one quarter inch longitudinal movement of the transmission servo rod.

15. The rod of claim 11, wherein the transmission servo rod is a first transmission servo that is an intermediate servo for activating an intermediate gear range, and further comprising a second transmission servo that is an overdrive servo for activating an overdrive gear range.

16. The rod of claim 11, wherein the external chamfer of the assembly sleeve is configured to seat against a chamfer of the transmission housing bore to form a contact point.

17. The rod of claim 16, wherein at least one of the first and second o-rings is configured to slide from under the assembly sleeve directly into the transmission housing bore.

18. The rod of claim 11, further comprising a third groove in the exterior surface of the rod disposed between the first and second grooves, wherein the third groove is wider than the first and second grooves, and wherein the aperture is substantially centered in the third groove.

19. The rod of claim 11, wherein the assembly sleeve is manufactured from plastic.

* * * * *